US006912747B2

(12) United States Patent
DuPree et al.

(10) Patent No.: US 6,912,747 B2
(45) Date of Patent: Jul. 5, 2005

(54) ENVELOPING PATIENT CARRIER AND METHOD FOR FACILITATING THE TRANSPORT AND TREATMENT OF PATIENTS

(75) Inventors: Donald E. DuPree, Chicago, IL (US); Frank W. Moriarty, Frankfort, IL (US)

(73) Assignee: D D and S, Inc., Chicago, IL (US)

( * ) Notice: Subject to any disclaimer, the term of this patent is extended or adjusted under 35 U.S.C. 154(b) by 0 days.

(21) Appl. No.: 10/412,434

(22) Filed: Apr. 11, 2003

(65) Prior Publication Data

US 2004/0200002 A1 Oct. 14, 2004

(51) Int. Cl.[7] ..... A61G 1/00
(52) U.S. Cl. ..... 5/625; 5/627; 5/628; 5/89.1
(58) Field of Search ..... 5/625–628, 89.1, 5/413 R; 2/69.5

(56) References Cited

U.S. PATENT DOCUMENTS

| | | | | | |
|---|---|---|---|---|---|
| 2,888,009 | A | * | 5/1959 | Taylor | 128/873 |
| 3,695,507 | A | * | 10/1972 | Sams | 383/116 |
| 3,750,202 | A | * | 8/1973 | Merikallio | 5/413 R |
| 4,579,753 | A | * | 4/1986 | Gjendemsjo | 428/17 |
| 4,736,474 | A | | 4/1988 | Moran et al. | |
| 4,742,587 | A | | 5/1988 | Dove | |
| 4,790,040 | A | * | 12/1988 | Grilliot et al. | 5/413 R |
| 4,895,171 | A | * | 1/1990 | Onik | 5/413 R |
| 4,922,562 | A | | 5/1990 | Allred et al. | |
| 4,998,296 | A | * | 3/1991 | Stames | 2/458 |
| 5,056,533 | A | | 10/1991 | Solano | |
| 5,109,555 | A | | 5/1992 | Fickler | |
| 5,138,731 | A | | 8/1992 | Harcrow, Jr. | |
| 5,150,487 | A | | 9/1992 | Hemphill | |
| 5,161,275 | A | | 11/1992 | Simpson et al. | |
| 5,189,746 | A | | 3/1993 | Horie | |
| 5,201,089 | A | | 4/1993 | Ferreira | |
| 5,213,062 | A | | 5/1993 | Canaday, Jr. | |
| 5,217,315 | A | | 6/1993 | Rosane | |
| 5,263,213 | A | | 11/1993 | Robertson et al. | |

(Continued)

FOREIGN PATENT DOCUMENTS

| | | | |
|---|---|---|---|
| GB | 2087224 A | * | 4/1982 |
| GB | 2105978 A | * | 4/1983 |

OTHER PUBLICATIONS

Purchase Order No. PN 59 S026005, dated Jul. 29, 1998.
Purchase Order No. PN 59 S027535, dated Oct. 11, 2000.
Purchase Order No. PG 59 DS801003, dated May 25, 2001.

*Primary Examiner*—Michael Trettel
(74) *Attorney, Agent, or Firm*—Bell, Boyd & Lloyd, LLC

(57) ABSTRACT

In one embodiment, the enveloping patient carrier of the present invention has a flexible top surface connected to a flexible bottom surface. The flexible top surface defines a re-closable torso opening, a face opening and a plurality of re-closable medical attention openings. The enveloping patient carrier also includes a plurality of carrying handles attached to the sides of the patient carrier. This type of patient carrier aids in the protection of emergency personnel from hazardous fluids (gas and liquid) and also enhances the medical attention and treatment of patients.

12 Claims, 2 Drawing Sheets

U.S. PATENT DOCUMENTS 5,274,864 A 1/1994 Morgan
5,384,926 A 1/1995 Al-Bargi
5,386,604 A * 2/1995 Ricketts ..... 5/625
5,442,821 A 8/1995 Weeks
5,502,854 A 4/1996 Daouk
5,509,159 A 4/1996 Du-Bois
5,515,549 A 5/1996 Wang
5,539,945 A 7/1996 Rosenberg et al.
5,568,663 A 10/1996 Brown
5,577,281 A 11/1996 Mital et al.
5,579,546 A 12/1996 Griskauskas
5,598,592 A 2/1997 Castellani
5,720,303 A 2/1998 Richardson
5,729,850 A 3/1998 Eskeli
5,745,938 A 5/1998 Bartley et al.
5,765,243 A 6/1998 Duncan et al.
5,787,529 A 8/1998 Landes
5,803,087 A 9/1998 Thompson
5,826,583 A 10/1998 Wood
5,839,137 A 11/1998 Butler et al.
5,862,547 A 1/1999 Bartley et al.
5,934,282 A 8/1999 Young, III et al.
5,978,989 A 11/1999 Chavez
5,987,673 A 11/1999 Smith
6,061,853 A 5/2000 Laaksonen et al.
6,073,287 A 6/2000 Svenson
6,094,761 A 8/2000 Ferko, III
6,125,485 A 10/2000 Way et al.
6,128,796 A 10/2000 McCormick et al.
6,164,671 A 12/2000 Darling, III
6,216,296 B1 4/2001 Carrasco
6,233,766 B1 5/2001 Ohman
6,241,653 B1 6/2001 Gauger et al.
6,250,713 B1 6/2001 Grohs et al.
6,327,723 B1 12/2001 Knight
6,357,063 B1 3/2002 Selby
6,381,781 B1 5/2002 Bourgraf et al.

* cited by examiner

ENVELOPING PATIENT CARRIER AND METHOD FOR FACILITATING THE TRANSPORT AND TREATMENT OF PATIENTS

BACKGROUND OF THE INVENTION

Rigid stretchers for transporting injured patients are well known. Certain known rigid stretchers are partially collapsible. These stretchers include one or more rigid support panels or beams. Because of the rigid panels or beams, these stretchers can be relatively heavy and cumbersome when handled by emergency personnel during rescue operations, and these stretchers can occupy a relatively significant amount of space in vehicles and other storage areas. Also, these known stretchers do not include a patient covering which aids in the protection of emergency personnel from hazardous body fluids from the patient and which guards the front of patient's body during transport.

One known rescue bag has been developed for keeping injured people warm while they are lying on stretchers. Though this rescue bag covers part of the patient's body, it is merely an accessory to a stretcher. Accordingly, one of the disadvantages of this rescue bag is that it does not function as a patient carrier. The emergency personnel must use a stretcher in conjunction with this rescue bag in order to pick-up, carry and transport an injured person to a desired location. In addition, such a rescue bag does not have medical treatment openings which provide emergency personnel with relatively quick access to select portions of the person's body, for example, to deliver essential treatments, such as IV solutions, heart defibrillation and the like.

Therefore, there is a need to overcome the foregoing disadvantages and to provide improvements to patient transporters.

SUMMARY OF THE INVENTION

The enveloping patient carrier of the present invention aids in the protection of emergency personnel as they transport patients in need of care, while also providing protection to patients with critical injuries. It is preferable that the enveloping patient carrier is fully flexible, relatively easily transportable, relatively light weight and configured to envelop a patient. Once a patient is placed in the patient carrier of the present invention, the transfer of blood, pathogens or other deleterious fluids is reduced, thus providing an extra level of protection for emergency personnel. In addition, patients with sensitive injuries are protected from their environment when placed in the patient carrier.

In an embodiment of the invention, the patient carrier comprises a flexible container defining a cavity adapted to receive a patient, providing separate sections for the torso and arms of the patient. The patient carrier covers the entire body of the patient and is configured with a face opening to allow the patient to breathe and use medical instruments, such as oxygen masks and respiration devices. The patient carrier is also configured with handles to assist emergency personnel in transporting the patient. The patient carrier may, in one embodiment, optionally be configured with a stretcher securing member for securing the patient carrier to a stretcher. It should be understood, however, that the patient carrier of the present invention enables users to transport patients without the use of a stretcher.

The patient carrier also has a reclosable entry to allow a patient to be placed in the patient carrier. In an embodiment, an interlocking zipper to minimize seepage is positioned down the center of the patient carrier enables a user to place a patient in the patient carrier and remove the patient from the carrier.

The patient carrier is also configured with medical instrument openings or treatment openings to facilitate the treatment of the patient. In an embodiment, the patient carrier is configured with medical treatment openings near the arms and chest area to accommodate medical instruments such as IV's, blood pressure bands, heart defibrillators, and the like. In an embodiment, the medical treatment openings are resealable, by the use of an interlocking zipper, hook and loop fastener or other suitable fastening apparatus.

The patient carrier of the present invention, in one embodiment, includes a patient encasement, fully bendable patient envelope, flexible body container or carriable bag having a plurality of re-closable openings and a plurality of carrying handles. The openings enable users to access non-ambulatory patients for purposes of monitoring the patient and providing medical treatment or medical attention. The patient carrier encloses a substantial portion of the patient in order to aid in the protection of health care personnel from infectious or hazardous fluids (gas or liquid) and to aid in the protection of the patient from various hazards, such as injury from sharp or abrasive objects, exposure to harmful fluids (gas or liquid) and exposure to relatively intense heat, fire or cold weather.

It is therefore an advantage of the present invention to provide an enveloping patient carrier and method for facilitating the transport and treatment of patients.

Another advantage of the present invention to provide a patient carrier which aids in the protection of health care personnel from exposure to infections or hazardous fluids during the handling of a patient.

Yet another advantage of the present invention is to provide limited protection to a patient from various hazards such as sharp or abrasive objects, exposure to harmful fluids, and exposure to heat, fire, or cold weather while being transported.

A key advantage of the present invention is to facilitate the carrying and storage of patient transport devices.

Yet another advantage of the present invention is to reduce the contamination of an emergency transport vehicle used to transport the patient.

Still another advantage of the present invention is to increase the ease of transporting patients.

Additional features and advantages of the present invention are described in, and will be apparent from, the following Detailed Description of the Invention and the figures.

DETAILED DESCRIPTION OF THE INVENTION

Figure 1:
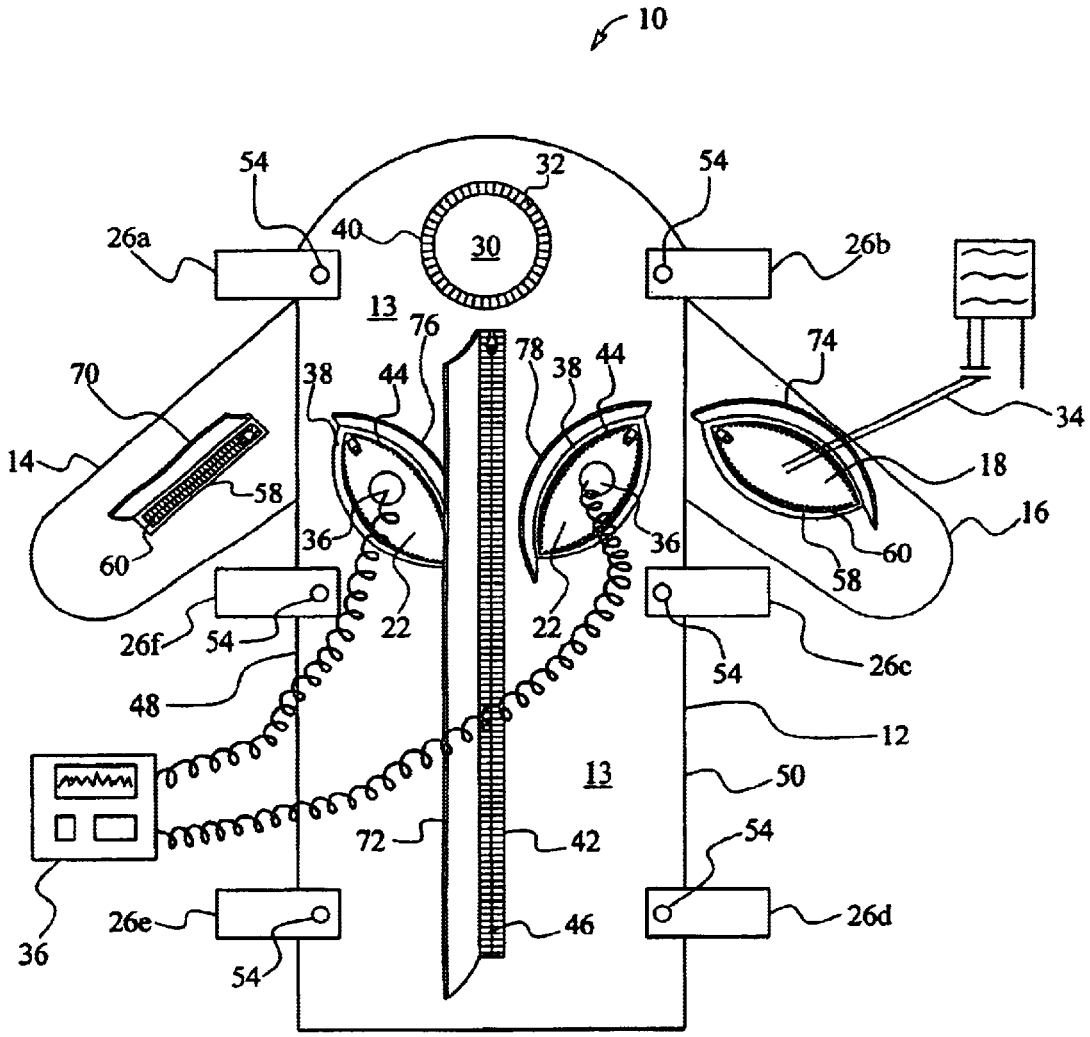
FIG. 1 is a top or plan view of a patient carrier in one embodiment of the invention.
Figure 2:
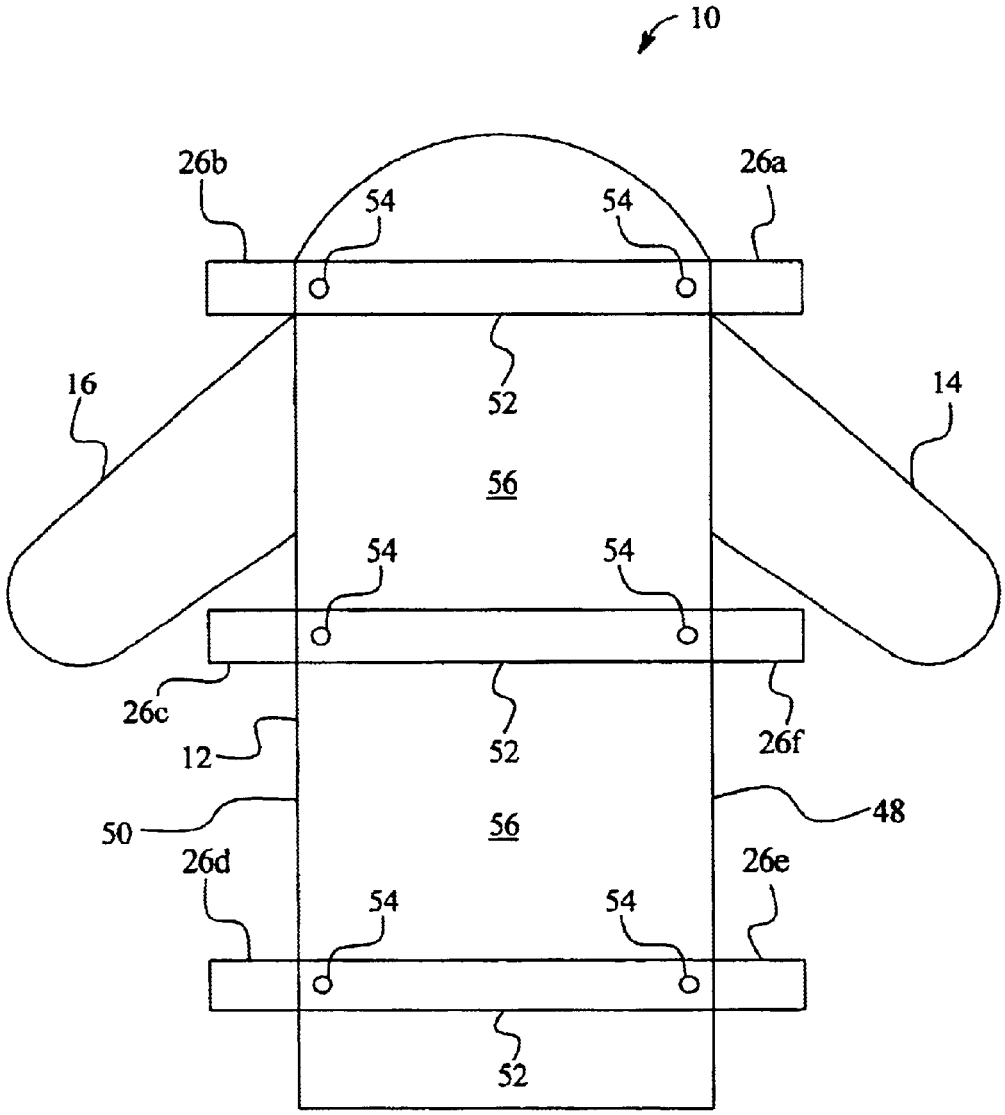
FIG. 2 is a bottom view of a patient carrier in one embodiment of the invention.

Referring to the drawings, FIGS. 1 and 2 illustrate one embodiment of the enveloping patient carrier or patient carrier 10 of the present invention. In one embodiment, the patient carrier 10 includes: (a) a torso portion 12 for holding the torso of the patient; (b) a right arm member 14 for holding the patient's right arm; and (c) a left arm member 16 for holding the patient's left arm.

The torso portion 12 preferably includes a top side 13 having: (a) a face wall 40 defining an opening 30 for the patient's face (not shown); (b) a plurality of chest access walls 38 defining chest openings 22; (c) a torso wall 42 defining a torso opening (not shown); (d) a re-adjustable fastener 44, preferably a zipper, attached to the chest access walls 38; (e) a re-adjustable fastener 46, preferably a zipper, attached to the torso wall 42; and (f) a plurality of handles 26*a* to 26*f* attached to the sides 48 and 50 of the torso portion 12.

The face wall 40 preferably includes a substantially circular elastic securing band or biasing member 32. This biasing member 32 aids in the placement and attachment of the face wall 40 to the patient's face or neck area. The chest openings 22 preferably function as medical instrument or medical treatment openings. These medical treatment openings enable health providers to access the patient's chest area with one or more medical instruments, such as a defibrillator 36, a stethoscope or other medical equipment.

The torso wall 42 preferably has a relatively straight configuration. However, the torso wall 42 can have any suitable configuration (not shown), such as a U-shaped or L-shaped configuration to aid in the placement of patients into the patient carrier 10.

The handles 26*a* to 26*f* can include any suitable hand grip member. Preferably, each handle 26*a–b* is an end of a single-piece elongated member 52, such as a strap. This elongated member 52 is preferably secured to the sides 48 and 50 of the torso portion 12 in a non-removable fashion, such as through the use of the fasteners 54 described below. Each such elongated member 52 is preferably positioned laterally along the underside or bottom side 56 of the torso portion 12. In this position, the elongated members 52 function as body weight distribution members which distribute the patient's body weight to the handles 26*a* to 26*f*.

It is also preferable that each handle 26*a* to 26*f* is constructed of a loop configuration at each end of each elongated member 52, wherein a suitable fastener 54, such as a snap-fit or crimp ring, secures the handles 26*a* to 26*f* to the torso portion 12. In one embodiment the fastener 54 defines an opening for receiving a safety rope, patient retrieval rope, hook or a fastener for securing the patient to a stretcher. It should be appreciated that the patient carrier 10 can include any suitable stretcher securing member to secure a patient in the patient carrier 10 to a stretcher or other relatively rigid transport device. For example, emergency personnel could use the patient carrier 10 by itself to rescue a patient from a fire and carry the patient to an ambulance. Once inside the ambulance, the personnel could secure the patient carry 10 to a stretcher or rigid structure.

The arm members 14 and 16 preferably each include: (a) an arm wall 58 defining an arm access opening (shown in arm member 16 only); and (b) a re-adjustable fastener 60 preferably a zipper, attached to the arm wall 58. The arm access openings preferably function as medical treatment openings which enable health care providers to access the patient's arm with one or more medical instruments, such as an intravenous (IV) catheter 34.

The fasteners 44, 46 and 60 of the patient carrier 10 allow general access to the patient and in particular, allow emergency or rescue personnel to treat the patient with medical instruments. It should be appreciated that other fasteners can be placed at other openings (not shown). The fasteners 44, 46, and 60 are preferably resealable interlocking zippers, however, they can include hook and loop fasteners (such as VELCRO®) or other suitable fasteners. The fasteners 44, 46 and 60 are preferably water resistant, such as interlocking zippers, to reduce the transfer of fluids out of and into the patient carrier 10. The fasteners 44, 46 and 60 and the opening defined by such fasteners are further protected by movable shields, guards or flaps 70, 72, 74, 76 and 78, which provide additional resistance to fluid transfer preferably when the fasteners 44, 46 and 60 are in a closed position.

It should be appreciated that the size, shape and placement of the walls 38, 42 and 58 may vary according to the needs of the application. In an embodiment, the arm walls 58 are longitudinally displaced along the arm members 14 and 16 and measure approximately eighteen inches in length, and the chest walls 38 are positioned across the upper torso portion 12 and are approximately eighteen inches in length.

Manufacture of Patient Carrier

The patient carrier 10 of the present invention may be manufactured using any suitable fastener or fasteners. In one embodiment, the patient carrier 10 includes the top side or top surface 13 and an underside or bottom surface 56 preferably secured together through a heat sealing or heat bonding technique, forming a mechanical bond between such surfaces. Such bond aids in reducing the transfer of infectious diseases or harmful fluids (gas or liquid) from the patient to emergency personnel. It should be appreciated that other suitable fasteners or fastening techniques can be used, such as adhesives, lines of stitching or strips of material. In another embodiment, the patient carrier 10 is manufactured, such as through extrusion, from one integral piece of material which defines a body pouch configured with suitable compartments to accommodate the face, torso and arms of a patient.

Method of Use

In one embodiment, the present invention includes a method of assisting in the transport and treatment of a patient. The emergency personnel or other users open the zipper 46 and place the patient's torso into the torso cavity (not shown) defined by the torso portion 12, while inserting the patient's arms into the arm cavities (not shown) defined by the arm members 14 and 16. The users also insert the patient's face partially through face opening 30, with the aid of the securing member 32, which is preferably an elastic band. Preferably two or more users grasp the handles 26*a* to 26*f* on both sides 48 and 50 of the patient carrier 10. The users then carry the patient to a desired location. At any time, the users can access the patient's arm areas or chest area by opening chest walls 38 or arm walls 58. The users can use these reclosable walls 38 and 58 openings to monitor and treat the patient.

Materials

The patient carrier 10 can be manufactured from any suitable flexible material. Such material is preferably relatively strong, water resistant and fire-resistant or fire proof. In addition, the material preferably has a pathogen barrier characteristic which decreases the transfer or spread of pathogens, diseases or harmful chemicals or biological substances. In one embodiment, the material includes multiple layers manufactured from a suitable polyethylene bonded or laminated to a reinforcement grid. The reinforcement grid can be constructed of nylon, cotton or any other suitable material.

In one embodiment, a material commercially available and known as Griffolyn® Type-55 is used to construct the patient carrier 10. This material includes a three-ply laminate combining two layers of low density polyethylene and a high-strength cord grid. This material preferably has the following characteristics:

(a) resistance to tears due to multiple layers and cord grid reinforcement;

(b) ultraviolet (UV) stabilization which helps protect the material from degradation during extended exposure to sunlight;

(c) cold-crack resistance which reduces or eliminates failures in extremely cold temperatures;

(d) low permeability which inhibits or eliminates moisture transmission;

(e) flexibility and light weight allow for easy handling and quick installation; and (f) relatively high durability.

In addition, such commercially available material has the following additional characteristics:

| Property | | ASTM Test | U.S. Value | Metric Value |
|---|---|---|---|---|
| Weight | | D-751 | 26.7 lbs/ 1000 $ft^2$ | 13 kg/ 100 $m^2$ |
| 3" Load @ Yield | MD | D-882 | 85 lbf | 378 N |
| | TD | D-882 | 82 lbf | 365 N |
| 3" Load @ Break | MD | D-882 | 30 lbf | 133 N |
| | PSI | D-882 | 1997 psi | 13.8 Mpa |
| | TD | D-882 | 25 lbf | 111 N |
| | PSI | D-882 | 1726 psi | 11.9 Mpa |
| 3" Elongated @ Break | MD | D-882 | 600% | 600% |
| | TD | D-882 | 525% | 525% |
| Tongue Tear | MD | D-2261 | 20 lbf | 89 N |
| | TD | D-2261 | 21 lbf | 93 N |
| PPT Resistance | MD | D-2582 | 20 lbf | 89 N |
| | TD | D-2582 | 22 lbf | 98 N |
| Drop Dart | | D-1709 | 1.3 lbs | 0.59 kg |
| Cold Crack | | D-1709 (mod.) | −35° F. | −37° C. |

It is preferable that the usable temperature range for such commercially available material has the following range: minimum of −35° F. or −37° C. to a maximum of 170° F. or 77° C.

The patient carrier 10 may also be insulated to keep a patient warm in cold climates. The insulation can be particularly useful, for example, when patients must be transported a long distance outdoors. The insulation material can be added to the inner or middle layers of the patient carrier 10. In an embodiment, insulation material is added between two or more layers of the material used to manufacture the patient carrier 10.

The patient carrier 10 may be variously shaped to accommodate patients of different sizes from infants to large adults. In an embodiment, the patient carrier 10 is approximately seven and one-half five feet long, three feet across the torso portion 12, with the arm members 14 and 16 measuring approximately two feet, three inches in length and eight inches in width.

The patient carrier 10 of the present invention can include: (a) one or more electronic devices, displays or electro-mechanical components; or (b) one or more electronic device securing members in order to assist users in monitoring, classifying or treating patients. In addition, the patient carrier 10 can be constructed in a variety of colors or coloring schemes to assist in the classification of patients by type of medical condition or any other factors. It should also be appreciated that part or all of the patient carrier 10 can be constructed of a suitable bullet proof or bullet resistant material.

The patient carrier 10 of the present invention, in one embodiment, includes a flexible body container or carriable bag having a plurality of re-closable openings and a plurality of carrying handles. These openings enable users to access non-ambulatory patients for purposes of monitoring the patient and providing medical treatment. The handles enable multiple users to carry the patient to and from desired locations. Furthermore, the patient carrier 10 encloses a substantial portion of the patient, preferably all portions except for the face, in order to: (a) aid in the protection of users from infectious or hazardous fluids (gas or liquid); and (b) aid in the protection of the patient from various hazards, such as injury from sharp or abrasive objects, exposure to harmful fluids (gas or liquid) and exposure to intensive heat, fire or cold weather. This type of patient carrier enhances the rescue and treatment of patients while aiding in the protection of emergency personnel and health care providers.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A patient carrier comprising:

a flexible top side;

a flexible bottom side;

at least one heat seal bond connecting the flexible top side to the flexible bottom side;

at least one handle connected to the flexible top side or the flexible bottom side;

at least one torso opening defined by the flexible top side;

a face opening defined by the flexible top side; and at least one medical treatment opening defined by the flexible top side, the medical treatment opening being different than the torso opening, and the medical treatment opening being different than the face opening.

2. A patient carrier comprising:

a flexible top side;

a flexible bottom side;

at least one connecting member connecting the flexible top side to the flexible bottom side;

at least one handle connected to the flexible top side or the flexible bottom side;

at least one torso opening defined by the flexible top side;

a face opening defined by the flexible top side;

at least one medical treatment opening defined by the flexible top side, the medical treatment opening being different than the torso opening, and the medical treatment opening being different than the face opening; and a plurality of arm members, each of the arm members coupled to both the flexible top side and the flexible bottom side, each of the arm members defining at least one medical treatment opening which is different than the medical treatment opening of the flexible top side.

3. The patient carrier of claim 2, wherein the connecting member includes a heat seal bond.

4. A patient carrier comprising:

a flexible top side;

a flexible bottom side;

at least one connecting member connecting the flexible top side to the flexible bottom side;

at least one handle connected to the flexible top side or the flexible bottom side;

at least one torso opening defined by the flexible top side;

a face opening defined by the flexible top side;

at least one medical treatment opening defined by the flexible top side, the medical treatment opening being different than the torso opening, and the medical treatment opening being different than the face opening;

a plurality of arm members, each of the arm members coupled to both the flexible top side and the flexible bottom side, each of the arm members defining at least one medical treatment opening which is different than the medical treatment opening of the flexible top side; and a zipper connected to the flexible top side or the flexible bottom side adjacent to the medical treatment opening of the flexible top side.

5. The patient carrier of claim 4, wherein the connecting member includes a heat seal bond.

6. A patient carrier comprising:

a flexible top side;

a flexible bottom side;

at least one connecting member connecting the flexible top side to the flexible bottom side, wherein the flexible top side and the flexible bottom side, as connected together by the connecting member, define a right wall and a left wall, the patient carrier including a plurality of handles connected to the right wall and the left wall;

at least one torso opening defined by the flexible ton side;

a face opening defined by the flexible top side;

at least one medical treatment opening defined by the flexible top side, the medical treatment opening being different than the torso opening, and the medical treatment opening being different than the face opening; and a plurality of elongated members connected to the handles, each of the elongated members extending between the right wall and the left wall adjacent to the flexible bottom side.

7. A patient carrier comprising:

a flexible pouch operable to support a patient having a body weight, the pouch having a top side, a bottom side, a right wall and a left wall;

a plurality of handles connected to the pouch including a plurality of handles connected to the right wall and a plurality of handles connected to the left wall;

a plurality of elongated weight distribution members, each of the elongated weight distribution members extending between the right wall and the left wall adjacent to the bottom side, the elongated weight distribution members operable to distribute a portion of the body weight to the handles;

a face opening defined by the top side;

a plurality of arm members connected to the flexible pouch, each of the arm members having: (a) a first end connected to the right wall or left wall of the flexible pouch; and (b) a second end;

at least one elongated re-closable torso opening defined by the pouch, the elongated re-closable torso opening having a size enabling the patient to be positioned inside the pouch;

a plurality of re-closable chest openings defined by the pouch, the re-closable chest openings located on opposite sides of the elongated re-closeable torso opening so as to provide access to a chest area of the patient for medical treatment purposes; and a plurality of re-closable arm access openings, each of the re-closable arm access openings defined by one of the arm members, each of the re-closable arm access openings positioned between the first end and the second end of one of the arm members so as to provide access to an arm of the patient for medical treatment purposes.

8. The patient carrier of claim 7, which includes a plurality of zippers, each of the zippers connected to the top side adjacent to one of the re-closable chest openings.

9. The patient carrier of claim 7, which includes a zipper connected to the top side adjacent to the elongated re-closable torso opening.

10. A method for facilitating medical attention to a person, the method comprising:

(a) providing a flexible patient carrier defining a cavity, the flexible patient carrier having a flexible top side and a flexible bottom side, the flexible top side defining: (i) a re-closable torso wall which defines at least one re-closable chest opening; (ii) a face opening; and (iii) at least one re-closable medical attention wall which defines a re-closable arm access opening, wherein the re-closable torso wall, the face opening and the re-closable medical attention wall have different positions on the flexible top side;

(b) opening the re-closable torso wall of the flexible patient carrier;

(c) placing the person into the cavity;

(d) enabling a face of the person to be positioned adjacent to the face opening;

(e) grasping a plurality of handles of the flexible patient carrier;

(f) carrying the flexible patient carrier to a desired location;

(g) opening the re-closable medical attention wall so as to expose a body portion of the person; and (h) providing medical attention to the body portion of the person.

11. The method of claim 10, wherein step (a) includes the step of providing a heat seal bond used to connect the flexible top side to the flexible bottom side.

12. The method of claim 11, wherein step (e) includes the step of providing support to a portion of a back of the person while carrying the person.

* * * * *